United States Patent [19]

Steingroever et al.

[11] 4,354,218

[45] Oct. 12, 1982

[54] PROCESS AND APPARATUS FOR MULTI-POLAR MAGNETIZATION OF ANNULAR PERMANENT MAGNETS

[76] Inventors: Erich A. Steingroever, Flensburger Strasse 33, 5300 Bonn; Dietrich Steingroever, An der Schanz 2, 5000 Köln 60, both of Fed. Rep. of Germany

[21] Appl. No.: 141,615

[22] Filed: Apr. 18, 1980

[30] Foreign Application Priority Data

Mar. 1, 1979 [DE] Fed. Rep. of Germany ..... 2907898

[51] Int. Cl.[3] ..... H01F 7/00

[52] U.S. Cl. ..... 361/147; 335/212

[58] Field of Search ..... 361/147, 148, 208, 210; 335/210, 212, 284

[56] References Cited

U.S. PATENT DOCUMENTS

| | | | |
|---|---|---|---|
| 3,088,056 | 4/1963 | Tevonian | 361/208 |
| 3,271,707 | 9/1966 | Koehler | 361/208 |
| 3,609,611 | 9/1971 | Parnell | 361/148 |
| 3,708,727 | 1/1973 | Wielebski et al. | 335/284 |
| 3,969,657 | 7/1976 | Oettinghause | 361/148 |
| 4,105,983 | 8/1978 | Barten et al. | 335/212 |
| 4,138,628 | 2/1979 | Smith | 335/210 |
| 4,162,470 | 7/1979 | Smith | 335/284 |
| 4,189,659 | 2/1980 | Andre et al. | 335/210 |

FOREIGN PATENT DOCUMENTS

| | | | |
|---|---|---|---|
| 789133 | 7/1968 | Canada | 361/147 |

*Primary Examiner*—J. D. Miller
*Assistant Examiner*—L. C. Schroeder
*Attorney, Agent, or Firm*—Fisher, Christen & Sabol

[57] ABSTRACT

Apparatus for magnetizing circular permanent magnet convergence rings used in kinescopes comprises a number of separate coils wound in composite fashion on one or more pole pieces of a magnetizing device which surrounds the convergence ring, selected groups of these coils being connected with individual magnetizing and demagnetizing circuits chosen to impart a complex multi-polar magnetization to a convergence ring by simultaneous actuation of these circuits.

19 Claims, 10 Drawing Figures

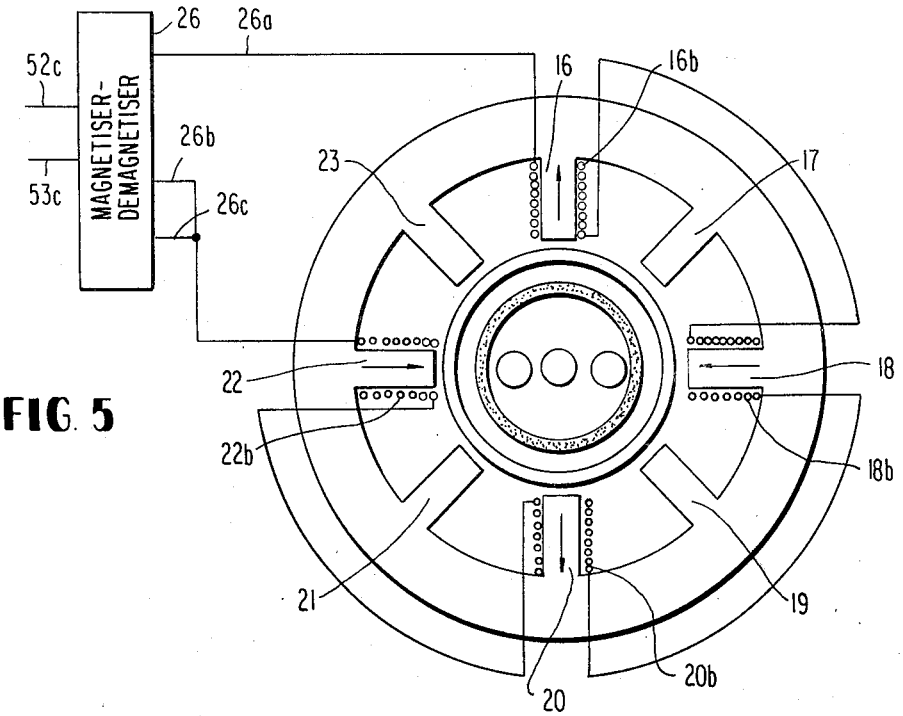
FIG. 5
FIG. 6
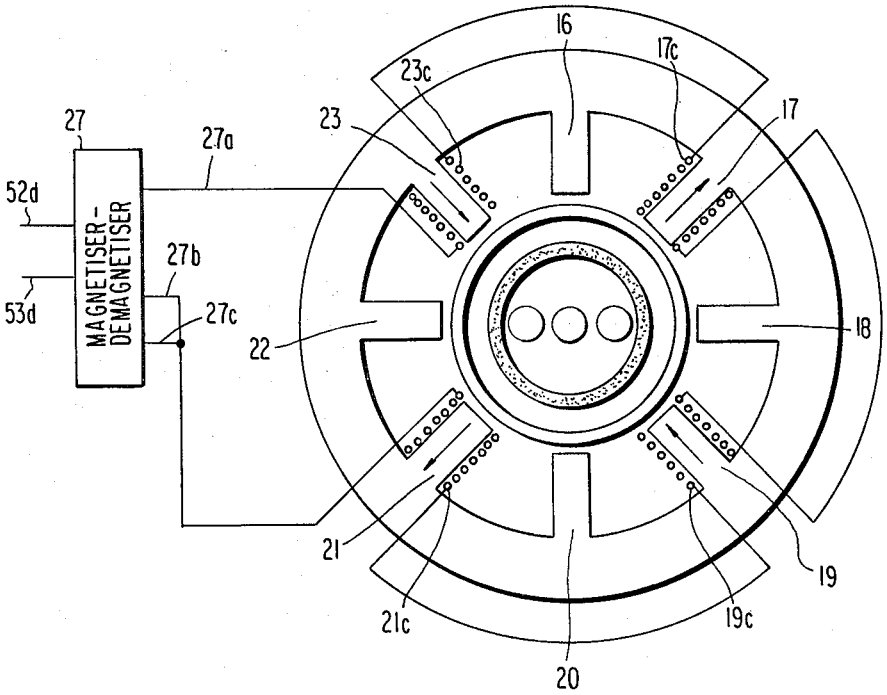

PROCESS AND APPARATUS FOR MULTI-POLAR MAGNETIZATION OF ANNULAR PERMANENT MAGNETS

BACKGROUND OF THE INVENTION

This invention relates generally to magnetic systems for adjusting the beam positions in a multiple-beam cathode ray tube, and more particularly to an arrangement for the complex magnetization of magnetic rings used to effect static convergence of the plurality of electron beams in an in-line, tri-beam shadow-mask color kinescope.

In a kinescope of this type, the electron beams are aligned to originate beam paths having axes lying essentially in a common plane, with a central beam oriented in registry with the tube neck axis and with respective outer beam paths symmetrically disposed on opposite sides of the central beam.

While the electron guns are designed to direct the three beam paths to strike coincident regions of the phosphor screen after they pass through the openings in the shadow mask in the absence of applied beam deflection, in commercial manufacturing practice it is nearly impossible to prevent the introduction of misconvergence errors which require the presence in the kinescope of some means to correct these errors.

Adjustable magnetic fields produced by individually adjustable permanent magnets, or electromagnets, have been employed for use with both in-line and delta gun configurations to produce the complex magnetic field patterns necessary to effect the requisite static convergence adjustments of the electron beams.

In U.S. Pat. No. 3,725,831, there is disclosed one form of static convergence system for an in-line tri-beam kinescope which consists of three pairs of flat ring-shaped magnets which, for convenience are supported on the exterior of the kinescope neck for individual rotation about the neck axis. One pair of juxtaposed rings are magnetized to provide six poles symmetrically positioned about the ring periphery and alternating in polarity, i.e. with reference to a given north pole location, the remaining pole locations are: S-60°; N-120°; S-180°; N-240° and S-300°. A second pair of rings is magnetized in a quadripolar arrangement symmetrically positioned about the ring periphery and alternating in polarity, i.e., with reference to a given north pole location, the remaining pole locations are: S-90°; N-180°; and S-270°. A third pair of rings is magnetized in a symmetrical bipolar arrangement about the periphery of the ring.

Conjoint rotation of the rings of a pair alters the direction of the resultant beam shifts while differential rotation of the rings of a pair alters the beam shift magnitude. Rotation of the quadripolar and sextipolar rings has no effect on the central beam since this region in the case of these rings is substantially field-free. Rotation of the quadripolar rings produces shifts of the two outer beams in equal but opposite directions, while rotation of the sextipolar rings produces equal shifts of the outer beams in the same direction. Finally, rotation of the bipolar rings causes all three beams to shift in same direction in equal amounts. As stated above, the extent of these shifts can be controlled in each case by angular displacement of one ring of a pair with respect to the other ring of the same pair.

An improvement over this basic system, in which only a single magnetic ring is required, is disclosed in West German Offenlegungsschrift No. 26 11 633. In this disclosure a single ferromagnetic ring is put in place concentric with the central beam and either within, or without, the neck of the kinescope. An electromagnetic device having eight radially arranged symmetrically located poles is then arranged around the magnetic ring on the outside of the kinescope. The polarity and field strength of each of the eight poles can be individually controlled to algebraically produce a complex field which acts on the three electron beams in the same manner as is accomplished by the rotation of the several magnetic rings described in U.S. Pat. No. 3,725,831. When the appropriate current values and directions of current flow have been determined, these values can be used to actuate a magnetizing device to magnetize the magnetic ring installed in the kinescope to generate the complex magnetic field required to produce static convergence and purity of the three electron beams in that particular kinescope. The auxiliary device for performing the initial deflection of the beams can be connected to store the necessary information for operating the magnetizing device or can be used with a control device for automatically magnetizing the installed convergence ring and, after this has been performed, both the auxiliary device and magnetizing device are removed.

A further development for static convergence of electron beams is shown in West German Offenlegungsschrift No. 26 12 607, in which two axially spaced ring magnets of relatively low coercivity are placed closely surrounding the electron beams, one of the magnets surrounds the grids of the electron beam generating system and other is located near the lugs facing the picture screen which serve to center the generating system within the neck of the kinescope. The rings may be composed of wire having a diameter of only about 1.5 mm formed into rings of about 30 mm. in diameter and a suitable material consists of an alloy of Fe, Co, V, and Cr having a coercive field strength $_BH_C$ of 24–32 kA/m. In this case the magnetization of the rings is accomplished by using a series of ferromagnetic rings provided with six, eight or twelve radially inwardly directed poles. Individually energized coils are wound on the sections of the ring between each pair of poles and the complex field magnetization is produced by separate control of the value and polarity of the current supplied to each of the coils. In one method the wire ring is first magnetized to saturation by means of a strong current pulse of the correct polarity to all of the coils and then demagnetized by pulses of opposite polarity and correctly adjusted values of current to each of the coils. Demagnetization can also be accomplished slowly with a 50 or 60 Hz alternating field until the optimum of increasing amplitude is reached.

SUMMARY OF THE INVENTION

In the magnetizing devices of the above-mentioned Offenlegungsschrift Nos. 26 11 633 and 26 12 607 very large pulse currents, on the order of 1000 amperes, more or less, must be supplied to each of the coils of the multi-polar magnetizing devices. Not only is it necessary to provide switches capable of carrying such currents to supply the correct polarity of current flow to each coil winding separately in order to magnetize a ring-shaped convergence magnet to saturation with the proper polar pattern induced over its periphery, but it is then necessary to reverse the polarity of the supply to each coil but the current supply must also be separately adjusted in order to demagnetize the ring-shaped convergence coil in such a way that it will generate the complex magnetic field necessary to accomplish its purpose.

Thus, in order to reproduce the magnet field pattern generated by the three pairs of rotatable permanent magnet rings of U.S. Pat. No. 3,725,831 a magnetizing device having eight circumferentially arranged poles is used in Offenlegungsschrift No. 26 11 633; first, to magnetize the single ring to saturation in a eight-pole pattern; then, by the use of reversing switches of high current-carrying capacity and voltage adjusting devices for each magnetizing coil to control the currents in each coil, to demagnetize the eight-pole pattern symmetrically.

An object of the present invention is to eliminate the necessity of heavy-duty switches while at the same time being able to use a single multi-pole magnetizing device for simultaneously generating in a single magnetic converge ring the complex combination of the two-pole, four-pole and six-pole patterns of the three pairs of rings in U.S. Pat. No. 3,725,831.

In order to do this certain of the radially inwardly directed pole pieces of an eight-pole magnetizing device are wound with three separate energizing windings, while the remaining pole pieces are each provided with five separate windings.

Selected ones of the coils on each pole are series-connected with selected coils on other pole pieces in such a way that six different patterns of energization and polarity of selected pole pieces is thereby established. For each of these groups separate circuits are provided, first for magnetizing to saturation and then for demagnetization to the appropriate value previously determined for the particular pole pattern.

The invention also provides for the simultaneous energization of all of the coils, both for magnetization and for demagnetization, after the proper voltages have been determined for the magnetization and demagnetization circuits for each pole pattern.

BRIEF DESCRIPTION OF THE DRAWINGS

FIG. 5 is a schematic diagram for quadrupolar magnetization and demagnetization in the X-direction;

FIG. 6 illustrates quadrupolar magnetization and demagnetization in the Y-direction;

DESCRIPTION OF A PREFERRED EMBODIMENT

Figure 1:
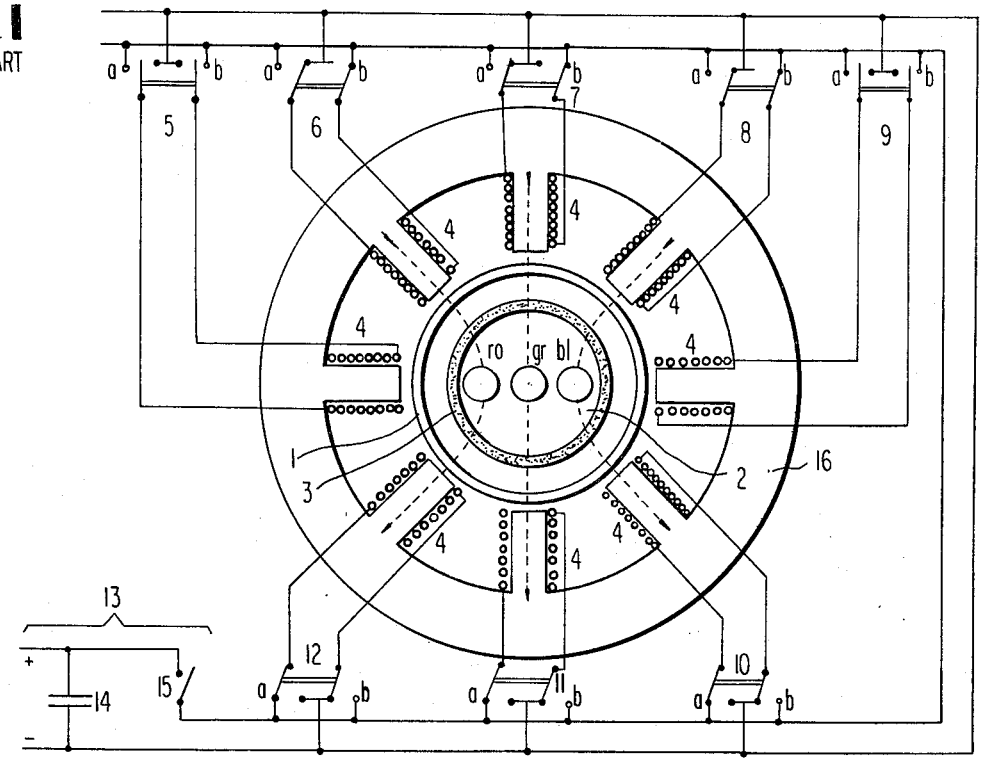
FIG. 1 PRIOR ART
FIG. 1 illustrates schematically the conventional eight-pole ferromagnetic ring device with its associated switching devices for controlling the polarities of the energizing coils for each pole piece.

A well known system for magnetizing permanent magnet ring-shaped convergence correcting devices is shown in FIG. 1, in which the numeral 1 denotes a cross-section of the glass envelope of a kinescope and the numeral 2 identifies the multi-perforated shadow mask positioned just behind the phosphor coated front face of the tube. Numeral 3 denotes the ring-shaped permanent magnet mounted inside the neck of the tube to closely encircle the red, green and blue electron beam sources mounted in alignment with each other. The ring 3 may comprise a metallic wire which is between 1 and 2 mm. in thickness.

The magnetizing device includes a circular ferromagnetic core having eight radially inwardly directed pole pieces spaced equi-angularly about the inner periphery of the core, each of which is wound with an energizing coil 4. Each of the coils is connected to an individual one of the eight double-pole, double-throw switches 5–12 which enables such coil to be separately connected, with reversible polarity, to a D.C. current impulse magnetizing circuit 13 which includes a capacitor 14 which can be charged from an electrical source (not shown) and then discharged to the respective coils 4 when switch 15 is closed.

In FIG. 1, switches 5 and 9 are shown in an "open" position whereby the two coils opposite from each other in the X are not included in the charging circuit. Switches 6, 7 and 8 are closed in their "b" positions, while switches 10, 11 and 12 are closed in their "a" positions which results in the production of magnetic fields in the coils connected by the first three switches which are radially opposite to the magnetic fields of the coils connected by the latter three switches. The combined effect of all of these fields is the production of a bipolar magnetic field in the Y direction as indicated by the arrows and broken lines in FIG. 1.

One disadvantage of this arrangement is that, due to the distance between the pole pieces and the convergence ring 3, extremely high currents, in the neighborhood of 1000 amperes, are required to produce the required fields and this means that the switches 5–12 must be capable of sustaining such loads without damage or being subject to short-circuits.

Perhaps a greater disadvantage is that for each of the six magnetic configurations in which the convergence is to be magnified, it is necessary to operate several of the switches to the "open" position, or the "a" or "b" position prior to energizing the coils. Added to that is the fact that, for each configuration it is preferable to magnetize the ring 3 to saturation in each configuration first and then demagnetize to the selected value, and this requires the reversal of each switch connected in the circuit.

Figure 2:
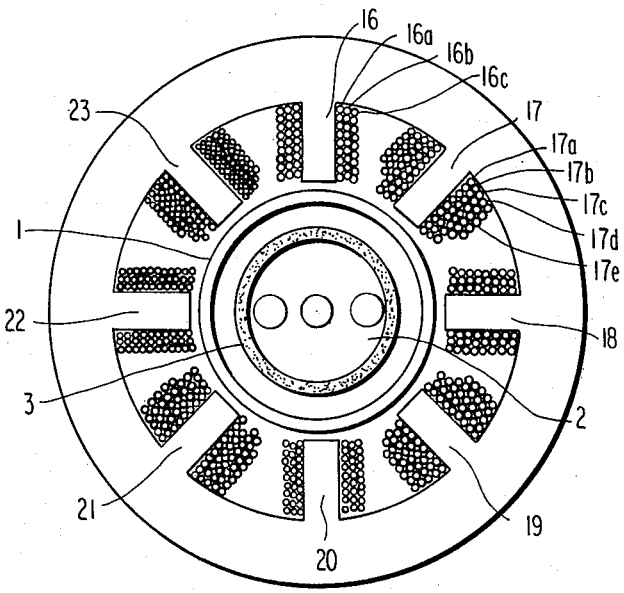
FIG. 2 is a schematic cross-section of a preferred form of eight-pole magnetizing device according to the invention shown in position to magnetize a permanent magnet convergence ring mounted on an in-line tri-beam shadow-mask color kinescope, looking the direction of the screen but without the connections to the pulse-generating circuits.
Figure 2A:
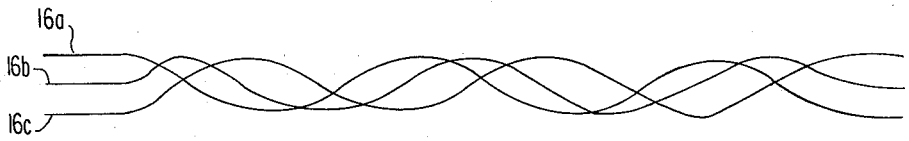
FIG. 2A is a schematic diagram of a twisted-wire arrangement for winding the coils on certain of the pole pieces of the magnetizing device of FIG. 2.
Figure 2B:
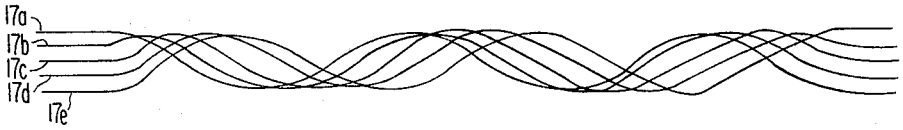
FIG. 2B is a schematic diagram of the twisted-wire arrangement used in other energizing coils in FIG. 2.

To overcome these difficulties a preferred form of magnetizing device according to this invention is shown in FIG. 2, in which a circular ferromagnetic core is provided with eight radially inwardly directed pole pieces 16, 17, 18, 19, 20, 21, 22 and 23. Four of these pole pieces; 16, 18, 20 and 22 are provided with three electrically isolated energizing windings, while the remaining pole pieces 17, 19, 21 and 23 are each provided with five electrically isolated energizing windings. As indicated in FIG. 2, each of the coils, for example 16*a*, 16*b*, 16*c*, may be wound on the pole piece in a separate layer, or layers. On the other hand a twisted 3-wire cable, as shown in FIG. 2A, may be used to form a multi layer coil winding in each of the pole pieces 16, 18, 20 and 22. Similarly, each of these pole pieces 17, 19, 21 and 23 may be provided with separately wound single, or multi-layer coils such as are identified by numerals 17*a*, 17*b*, 17*c*, 17*d* and 17*e* or five separate wires may be twisted together, as shown in FIG. 2B, to form a cable which can be used to wind a composite multi-layer energizing coil. While the individual coils are identified by numerals in FIGS. 2, 2A and 2B only in connection with pole pieces 16 and 17, it will be understood that the arrangement of windings on pole pieces 18, 20 and 22 will be similar to the windings of pole piece 16, while the windings on pole pieces 19, 21 and 23 will be similar to the windings on pole piece 17. For the sake of simplicity and clarity, the circuit connection for the windings are not shown in FIG. 2, but will be shown and described in connection with succeeding Figures.

Figure 3:
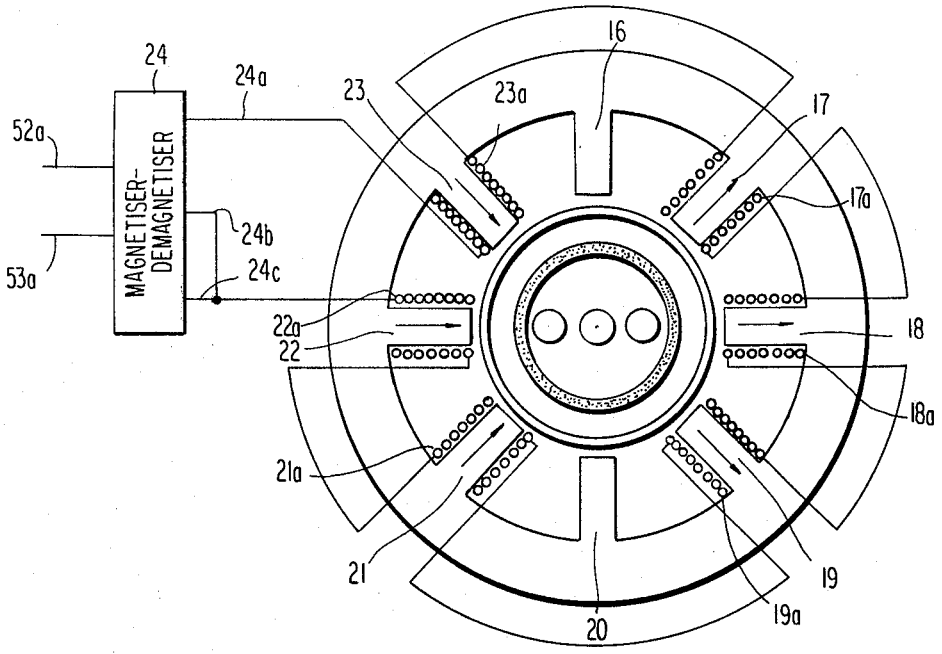
FIG. 3 is a schematic diagram of the coil connections for bipolar magnetization and demagnetization of the convergence device in the X-direction.
Figure 4:
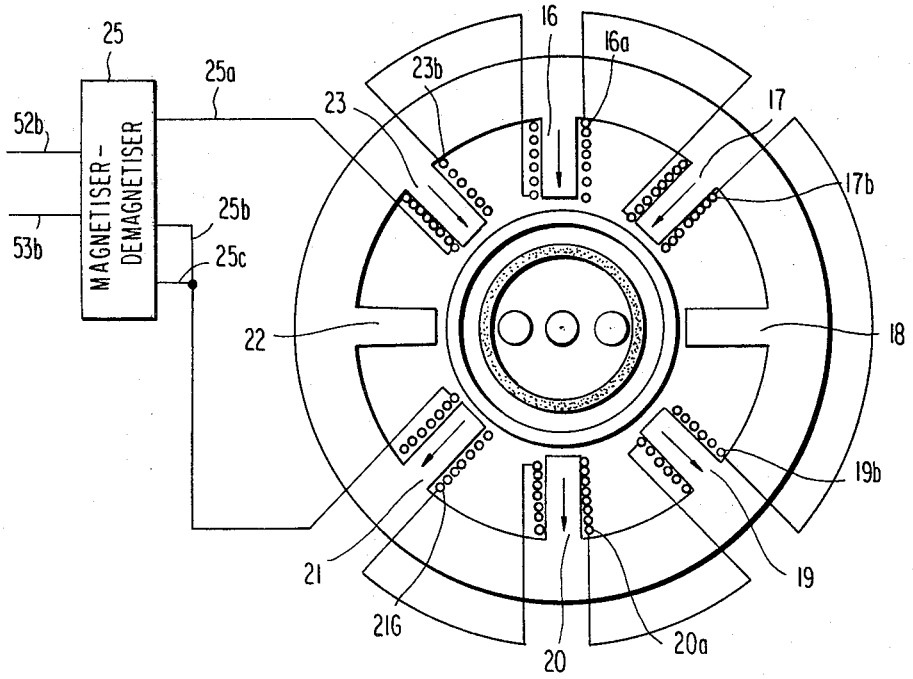
FIG. 4 is a schematic diagram for bipolar magnetization and demagnetization in the Y-direction.

For example, in FIG. 3 only the winding 17*a*, 18*a*, 19*a*, 21*a*, 22*a* and 23*a* on the six pole pieces 17, 18, 19, 21, 22 and 23 are used for bipolar magnetization of convergence ring 3 in the X direction. The coils are connected in series, taking care to see that the radial directions of the magnetic fields generated by coils 17*a*, 18*a* and 19*a* are opposite to the radial directions of the magnetic fields generated by coils 21*a*, 22*a* and 23*a*. One end of this series connected circuit is connected by wire 24*a* to a common point in a magnetizing and demagnetizing circuit, indicated generally by numeral 24, which will be described in detail later. The other end of the series circuit is connected into circuit 24 by leads 24*b* and 24*c* to provide the necessary reversal of polarity from the impulse charging circuits required for bipolar magnetization of ring 3 first to saturation, followed by the appropriate demagnetization.

FIG. 3 shows the circuit connections for the windings to produce bipolar magnetization of ring 3 in the Y direction. In this case, the first windings 16*a* and 20*a* of pole pieces 16 and 20 are connected in the series circuit, while none of the windings on pole pieces 18 and 22 are included. In the case of pole pieces 17, 19, 21 and 23 other windings than those needed for bipolar magnetization in the X direction must be used, namely those indicated by numerals 17*b*, 19*b*, 21*b* and 23*b*, and in this case the connections to the winding must be such that the radial fields produced by coils 23*b*, 16*a* and 17*b* must be radially opposite in direction to the fields produced by coils 19*b*, 20*a* and 21*b*. One end of the series connected windings is connected by wire 25*a* to magnetization-demagnetization circuit 25 while the other end is connected by leads 25*b* and 25*c* to the circuit 25.

FIGS. 5 and 6 illustrate the winding arrangements used to produce quadrupolar magnetization of ring 3 in the X and Y directions, respectively. Only four windings are used in each case; for magnetizing in the X direction winding 16*b*, 18*b*, 20*b* and 22*b* are connected in series, with coils 16*b* and 20*b* connected to produce magnetic fields radially opposite to the magnetic fields of coils 18*b* and 22*b*. One end of the series circuit is connected by wire 26*a* to magnetiser-demagnetiser circuit 26, while the other end is connected to leads 26*b* and 26*c*. The series circuit of FIG. 6 includes windings 23*c*, 17*c*, 19*c* and 21*c* connected to magnetiser-demagnetiser 27 by leads 27*a*, 27*b* and 27*c*, the connections in the series circuit being such that coils 17*c* and 21*c* generate magnetic fields opposed to those of windings 19*c* and 23*c*.

Figure 7:
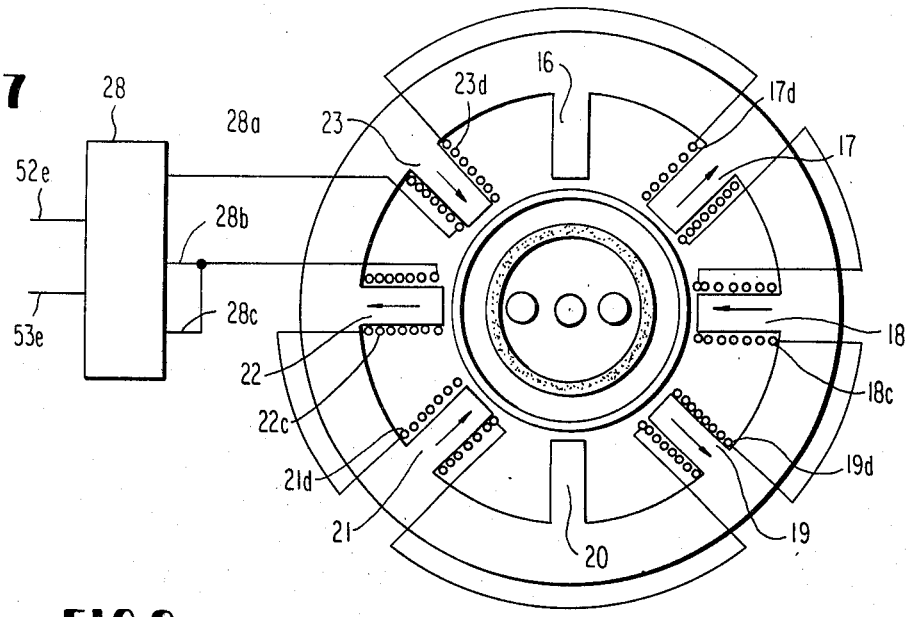
FIG. 7 is a schematic for 6-pole magnetization-demagnetization in the X-direction.
Figure 8:
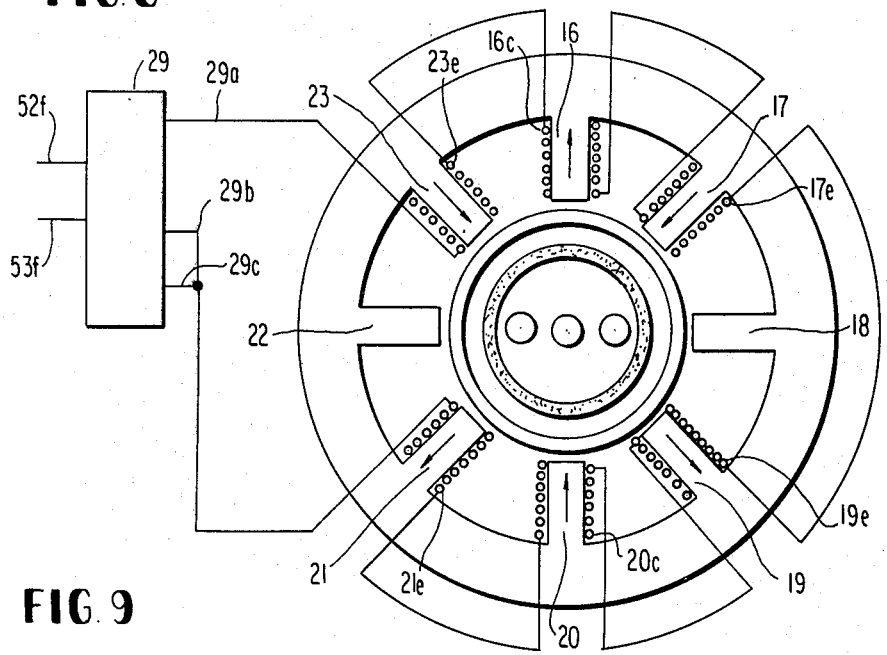
FIG. 8 illustrates 6-pole magnetization-demagnetization in the Y-direction.

The arrangements for producing a six-pole magnetization in ring 3 in the X and in the Y directions are shown in FIGS. 7 and 8 respectively. For the X-direction the windings 23*d*, 17*d*, 18*c*, 19*d*, 21*d*, and 22*c* and connected in series to produce magnetic fields in coils 17*d*, 19*d* and 22*c* which oppose the fields generated by windings 18*c*, 21*d* and 23*d*. Connections to magnetiser-demagnetiser circuit 28 are made by leads 28*a*, 28*b* and 28*c*. For the Y-direction magnetization, windings 23*e*, 16*c*, 17*e*, 19*e*, 20*c* and 21*e* are used, the fields of windings 16*c*, 19*e* and 21*e* being opposed to those of windings 17*e*, 20*c* and 23*e*. Magnetiser-demagnetiser 29 is connected by leads 29*a*, 29*b* and 29*c* to the series circuit of the windings.

Figure 9:
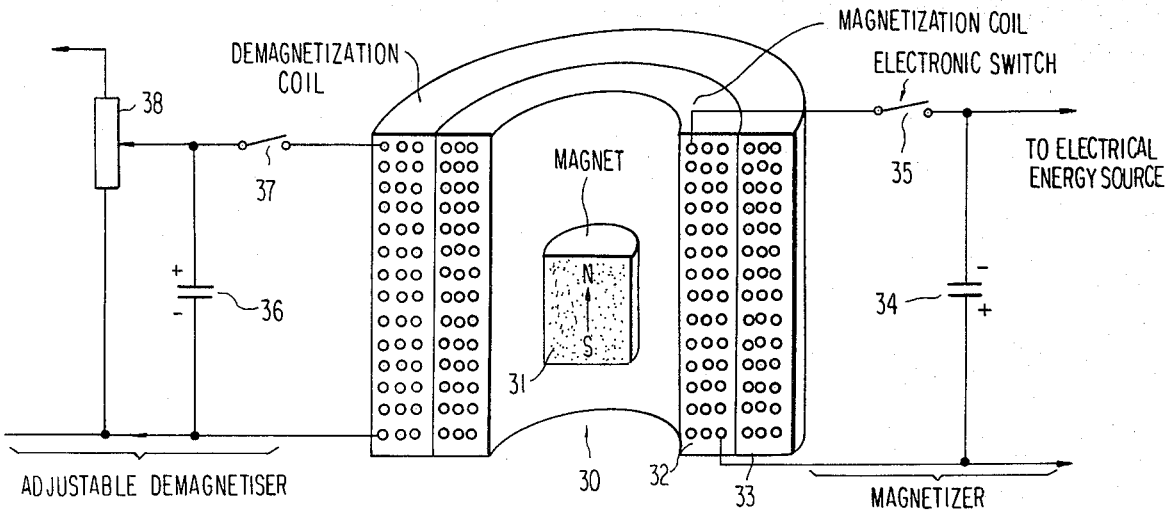
FIG. 9 is a cross-section of a simple composite winding for magnetizing and demagnetizing a conventional bipolar axially magnetized permanent magnet.

The basic principle of the invention, on a simplified scale is shown in FIG. 9, wherein a composite magnetizing and demagnetizing device, indicated generally by numeral 30 is used to axially magnetize the rod-shaped permanent magnet body 31 (shown in cross-section in the drawing). The magnet body is positioned concentrically within a pair of windings 32 and 33, each of which may consist of a single layer of turns of wire, or may be multi-layered, as shown. One of the windings may be wound upon the other, or a single composite winding, using a pair of twisted wires, may be used as explained in connection with the 3-wire and 5-wire coils of FIGS. 2A and 2B. A conventional impulse charging circuit, which includes a capacitor 34 connected to coil 32 by switch 35, is supplied by a source of D.C. electrical energy (not shown). Another impulse charging circuit includes capacitor 36 connected to coil 33 by switch 37. Capacitor 36 is connected to coil 33 by switch 37. Capacitor 36 is connected to a source of D.C. electrical energy (not shown) of opposite polarity to that of the supply for capacitor 34. Furthermore, the voltage of the source for capacitor 34 is chosen to be sufficient to magnetize the body 31 to saturation, whereas the voltage supply to capacitor 36 is controlled, as by a rheostat 38 to provide a lower voltage.

Thus, in operation, after the magnet body 31 has been placed in position in the device 30, and with switches 35 and 37 both in their "open" positions, the capacitors 34 and 36 may be charged to their respective voltages of opposite sign. Thereafter, switch 35 may be closed to discharge capacitor 34 into coil 32 to magnetize the body 31 to saturation. Following that, switch 37 can be closed to discharge capacitor 36 into coil 33 which will subject the body 31 to a lesser magnetic field, but in the opposite direction to that which was previously produced by coil 32. The extent of this demagnetization is, obviously, controlled by the device 38.

The advantage of this arrangement is that the entire process of magnetization of a permanent magnet can be performed at a single station without the necessity for magnetizing the body at one station and demagnetizing it at another station. Where a series of magnet bodies are being produced this avoids the possibility of errors ocurring due to misplacement of a magnet with respect to a flux producing coil at one, or the other, of the stations.

Figure 10:
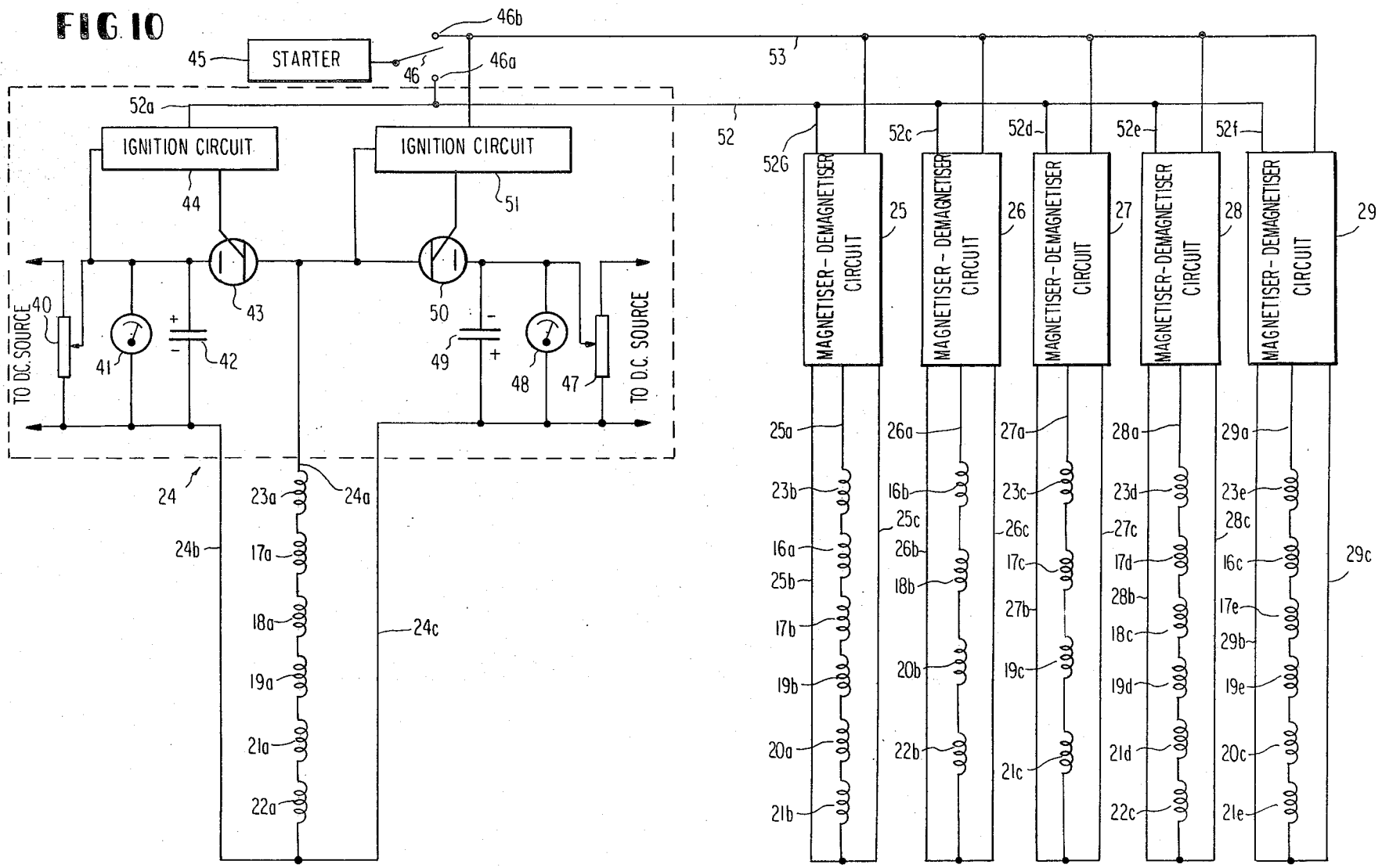
FIG. 10 is a schematic diagram of a circuit for simultaneous magnetization and simultaneous demagnetization of the coils of the device shown in FIGS. 2–8.

The impulse charging system of FIG. 10 is designed to make it possible to simultaneously magnetize to saturation, and thereafter to simultaneously demagnetize at selective values, all of the windings associated with the eight-pole device of FIG. 2 without the necessity for employing expensive and cumbersome high-current carrying capacity switches. In FIG. 10, only the circuit for magnetiser-demagnetizer 24, of FIG. 3, is shown in detail because the internal construction of the devices 25 through 29 is similar in all respects. FIG. 10 also discloses the circuit connections between each set of windings shown individually in FIGS. 3 through 8. The circuit enclosed with the broken-line rectangle 24 shows an impulse magnetizing system having a voltage control device, such as a potentiometer 40, connected across a D.C. electrical energy supply (not shown) with its variable output connected in parallel with an indicator, such as a voltmeter 41, and a charging capacitor 42. One side of the line connected to the capacitor also connects with the lead 42*b*, which goes to one end of the series-connected windings 23*a*, 17*a*, 18*a*, 19*a*, 21*a* and 22*a*, while the other wire from the capacitor goes to one side of a high current-carrying switching device, such as an ignitron 43, whose other side leads to a connection with wire 24*a* leading to the other end of the series-connected windings. Ignitron 43 is provided with a conventional ignition circuit 44 which, in turn is controlled by a starter circuit 45 having a switch 46 which has an "open" position, as shown, and can make selective connection with either one of contacts 46*a* or 46*b*. An impulse demagnetizing circuit is also included, which comprises a potentiometer 47 connected to a D.C. energy source (not shown) of opposite polarity to that of the first source. The adjustable output of the potentiometer is connected in parallel with an indicator 48 and charging capacitor 49 which has one side also connected to wire 24*c* leading to one end of the series-connected windings. The other end of the capacitor leads to one side of another switching device such as ignitron 50, provided with an ignition circuit 51 which is also controlled by the starter circuit 45.

In operation, it is first necessary to adjust the potentiometer 40 to supply a potential to the capacitor 42 which will ensure that when it is discharged the current supplied to the windings 23*a*, 17*a*, 18*a*, 19*a*, 21*a* and 22*a* will be sufficient to generate magnetic fields which, when combined, will saturate the convergence ring 3 with a bipolar configuration in the X direction, as shown in FIG. 3.

In the same way, potentiometer 47 is adjusted to supply a voltage to capacitor 49 which, when discharged will supply a current impulse to the windings which will produce the required amount of bipolar demagnetization of ring 3 in the X direction.

As stated above, the circuits 25 through 28 are similar to that of the circuit 24, just described, each of these circuits being connected with one specific arrangement of windings on the eight-pole core. Thus, in each of these circuits equivalent voltage supplies will be adjusted to provide the correct impulse charges, to be supplied by capacitors equivalent to capacitors 42 and 49 for magnetization to saturation and for controlled demagnetization of convergence ring 3 according to the functions of the respective windings connected to each of the circuits 25 through 29. Once the voltages have been established and the corresponding capacitors 42 and 49 in each of the magnetizer circuits have been charged, the starter switch 46 is moved to contact 46*a* which is connected through a common feeder line 52 and a branch lead 52*a* to actuate ignition circuit 44. This causes ignitron 43 to become conductive and allows capacitor 42 to discharge a current impulse through the windings 23*a*, 17*a*, 18*a*, 19*a*, 21*a* and 22*a*. At the same time starter circuit 45, through the branch leads 52*b*, 52*c*, 52*d*, 52*e* and 52*f*, will cause energization of the windings associated with each of the magnetiser circuits 25 through 29. As a result all of the windings on all of the pole pieces will be energized simultaneously to magnetize the convergence ring to saturation in a symmetrical pattern which combines the separate bipolar, quadrupolar and six pole patterns in both the X and Y directions previously described.

Following magnetization to saturation, switch 46 is shifted to contact 46*b* which will cause the starter circuit, through the feeder line 53 and branching leads 53*a*, 53*b*, 53*c*, 53*d*, 53*e* and 53*f* to actuate ignition circuit 51 and all of the equivalent devices in circuits 25 through 29 causing ignitron 50 and all of the other corresponding devices to become conductive. This discharges capacitor 49, and the other corresponding capacitors, to send a current impulse through the windings associated with each of the demagnetiser circuits in a direction opposite to the current impulses previously discharged by capacitor 42 and its equivalents. This demagnetizes the convergence ring 3 to the extent that while the complex of bipolar, quadrupolar and six pole patterns remain the magnetization of ring 3 in the direction of each of its poles will not necessarily be equal, but will have assumed the individual values necessary to properly deflect the three electron beams.

In FIG. 10 a single starter circuit 45 has been shown, but will be understood that separate starter circuits could be included in each magnetiser-demagnetiser circuit 24–29 and connected to a single switch 46, or that a separate switch could be provided for each circuit, with the switches being mechanically ganged together for simultaneous operation. Also, while it has been suggested that all of the demagnetizing capacitors be charged for demagnetization in a single step, it is also possible to demagnetize the converge ring gradually, in several steps using successive discharges of the demagnetizing capacitors. This increases the stability of the operating point of the permanent magnet convergence ring 3.

While, in the foregoing description it is suggested that the various coils, or windings, may be connected in series for charging by an impulse capacitor, it is possible to connect the coils in parallel for this purpose. It should also be understood that the scope of the invention is not limited to the particular impulse charge producing circuit described but is only exemplary. Furthermore, it should be understood that, within the physical limits of mechanical design, any number of polar patterns may be simultaneously produced by the use of selected additional windings, each of these patterns having an even number of poles.

We claim:

1. Apparatus for the magnetization to saturation and adjustable demagnetization to a desired value of permanent magnets, comprising separate magnetization and demagnetization coils, each of said coils being electrically isolated from each other and being wound upon the same coil form, and circuit means comprising impulse electrical charging means connected with one of said coils for magnetizing a permanent magnet to saturation with a predetermined polarity, said circuit means also including impulse electrical charging means connected with the other of said coils for subsequently partially demagnetizing said permanent magnet, the force of demagnetization being opposite to the direction of magnetization.

2. Apparatus of claim 1, wherein said separate coils comprise at least two electrically isolated wires wound in succession upon the same supporting form.

3. Apparatus of claim 1, wherein said separate coils comprise at least two electrically isolated wires twisted together along their lengths to form a composite strand, said strand being wound to provide at least two energizing coils occupying substantially the same space.

4. Apparatus of either of claims 2 or 3, wherein said wires comprise at least a portion of a ferromagnetic core.

5. Magnetizing device for the production of a variable number of magnetic poles in an annular permanent magnet body, each of said poles having a selectively variable magnetic strength, comprising a plurality of composite magnetizing coil means, each of said coil means comprising at least two electrically isolated windings each designed to produce similarly shaped substantially identically located magnetic fields of individually selected strengths, means to mount said coil means with their magnetic axes radially directed with respect to said annular magnet body, selected ones of said windings being connected together to provide a plurality of sets of connected windings each of said sets of windings producing a multi-polar magnetization field which differs in angular configuration from the angular configuration of the magnetization field produced by any other set of windings, and switching means for simultaneously connecting at least two of said sets of winding to a source of electrical energy.

6. Magnetizing device of claim 5, wherein eight of said coil means are mounted in an annular array, and six sets of connected windings are provided to produce six different polar magnetization fields.

7. Magnetizing device of claim 6, wherein said six sets of windings consists of:

(a) six windings connected together for a bipolar magnetization field in the X direction;
(b) six windings connected together for a bipolar magnetization field in the Y direction;
(c) four windings connected together for a quadrupolar magnetization field in the X direction;
(d) four windings connected together for a quadrupolar magnetization field in the Y direction;
(e) six windings connected together for a six-pole magnetization field in the X direction; and
(f) six windings connected together for a six-pole magnetization field in the Y direction.

8. Magnetization device according to any one of claims 5, 6 or 7, wherein the windings of said coil means are wound one upon another.

9. Magnetization device according to any one of claims 5, 6 or 7, wherein the wires of all of the windings of said coil means are twisted together and wound simultaneously.

10. Magnetization device of claims 5, 6 or 7, wherein selected windings are connected together in a plurality of separate circuits, each of said circuits also including separate impulse magnetization means, each of said circuits producing a different magnetizing field pattern.

11. Magnetization device of claim 10, wherein each of said separate magnetization means includes resistance means for selectively adjusting the strength of its magnetize field pattern.

12. Magnetization device of claim 11, wherein each of said separate magnetization means includes two capacitors, means for charging each of said capacitors at selectively adjustable electrical potentials of opposite polarity, and means for successively discharging said capacitors to the windings in the respective circuit in which the magnetization means is included.

13. Magnetization device of claim 12, wherein the magnetizing field patterns of the selected windings are superimposed.

14. Magnetization device of claim 13, wherein the capacitors of the selected circuits are simultaneously discharged.

15. Magnetization device of any one of claims 5, 7 or 14, which also includes a tri-color in-line kinescope, said kinescope including a ring-shaped permanent magnet body for correcting the electron beam paths, said magnet body being disposed coaxially in the magnetic fields produced by said composite magnetizing coils.

16. Process for producing complex multi-polar magnetization of annular permanent magnets, comprising the step of simultaneously producing by means of impulse electrical charging means at least two magnetic fields having similar paths but being of different respective intensities.

17. Process of claim 16, which includes the additional step of simultaneously producing by means of impulse electrical charging means at least two magnetic fields having paths similar to the paths of the first mentioned magnetic fields but of opposite polarity.

18. Process of either claim 16 or 17, wherein the multi-polar magnetization simultaneously produced by the magnetic fields equals n, where n is an even number.

19. Process claim 18, wherein x number of additional multi-polar magnetization fields are simultaneously produced, each additional magnetization field having n number of poles, where x is any number and n is an even number.

* * * * *